US006312634B1

(12) United States Patent
Cho et al.

(10) Patent No.: US 6,312,634 B1
(45) Date of Patent: Nov. 6, 2001

(54) PROCESS OF MAKING POLYESTER FIBERS

(75) Inventors: Eun Lai Cho, Seoul; Duk Ho Oh; Hyek Se Lee, both of Ulsan-shi, all of (KR)

(73) Assignee: Hyosung Corporation, Seoul (KR)

( * ) Notice: Subject to any disclaimer, the term of this patent is extended or adjusted under 35 U.S.C. 154(b) by 0 days.

(21) Appl. No.: 09/517,600

(22) Filed: Mar. 2, 2000

(30) Foreign Application Priority Data

May 18, 1999 (KR) ..... 99-17708
Oct. 14, 1999 (KR) ..... 99-44523

(51) Int. Cl.[7] ..... D01D 1/10; D01D 5/098; D01D 5/16; D01F 6/62; D06M 13/184

(52) U.S. Cl. ..... 264/130; 264/169; 264/210.5; 264/210.7; 264/210.8; 264/211.14

(58) Field of Search ..... 264/130, 169, 264/210.5, 210.7, 210.8, 211.14

(56) References Cited

U.S. PATENT DOCUMENTS

| | | | | |
|---|---|---|---|---|
| 4,101,525 | | 7/1978 | David et al. . | |
| 4,491,657 | | 1/1985 | Saito et al. . | |
| 4,690,866 | | 9/1987 | Kumakawa et al. . | |
| 4,698,260 | * | 10/1987 | Sasaki et al. | 428/399 |
| 4,900,496 | * | 2/1990 | Andrews, Jr. et al. | 264/103 |
| 6,136,435 | * | 10/2000 | Yoshimura et al. | 428/372 |

* cited by examiner

*Primary Examiner*—Leo B. Tentoni
(74) *Attorney, Agent, or Firm*—Clark & Elbing LLP

(57) ABSTRACT

A method for preparing industrial polyester fibers involving melt-spinning polyester chips through a nozzle, oiling the resultant filaments with an aqueous emulsion oiling agent, and producing, from the filaments, multifilament yarn at a speed of 2000–3300 m/min.

4 Claims, 2 Drawing Sheets

[Fig.1]
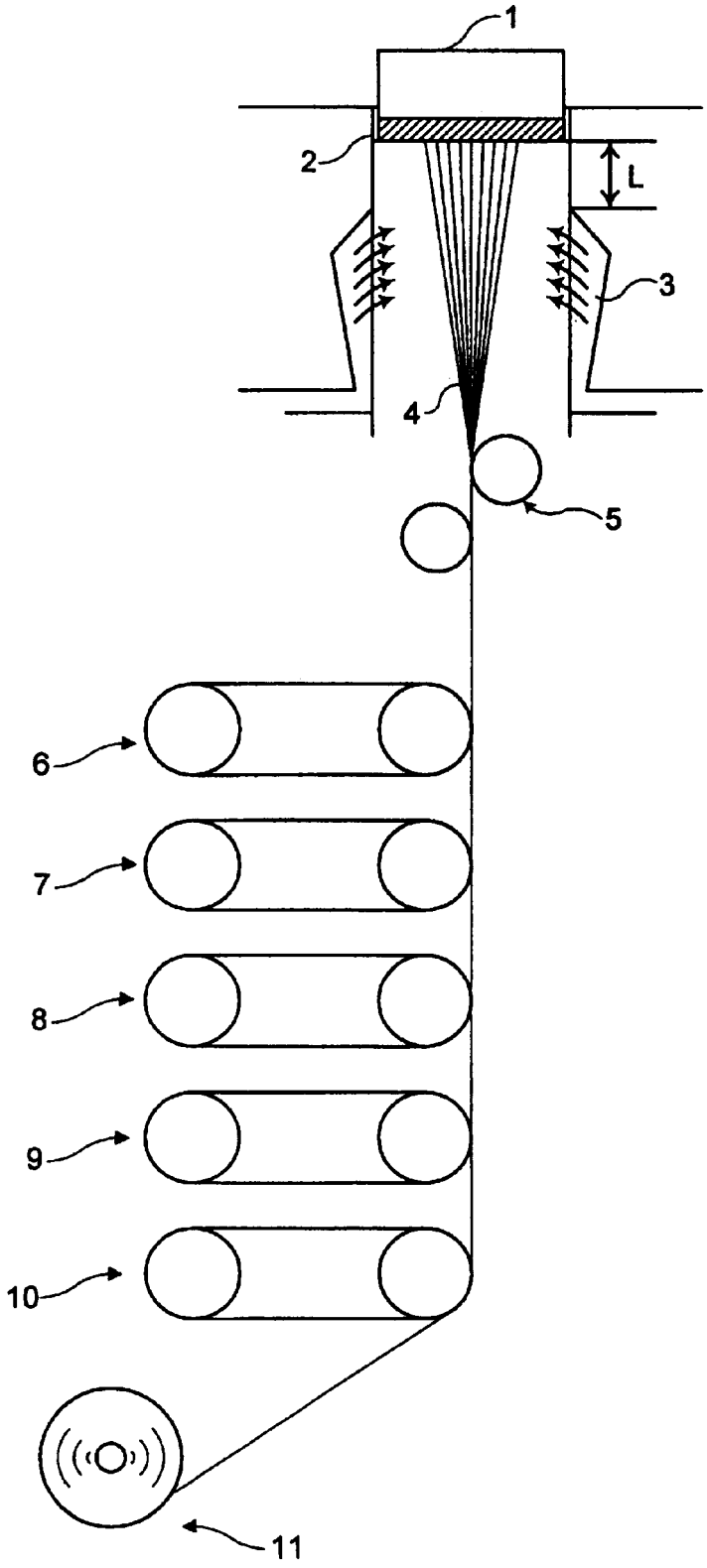

[Fig.2]
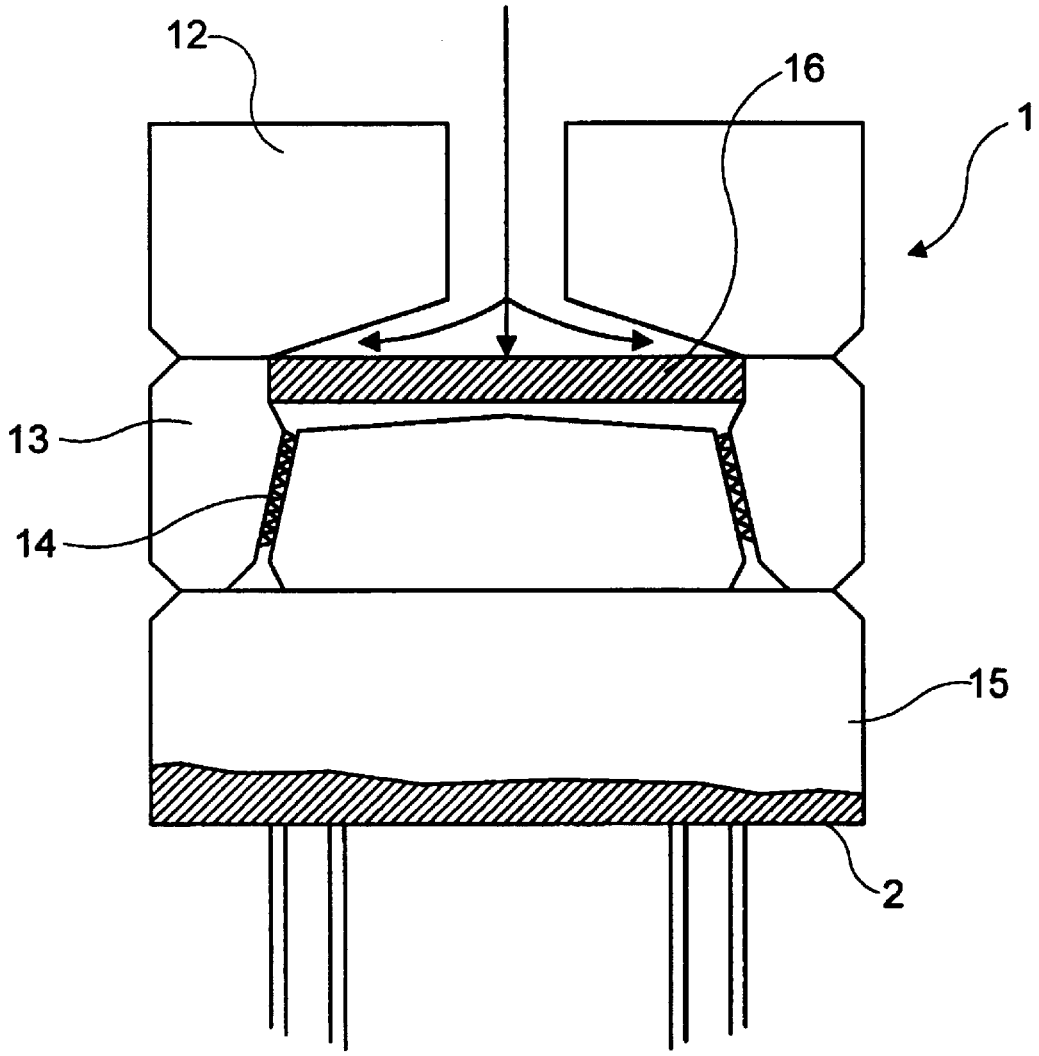

PROCESS OF MAKING POLYESTER FIBERS

BACKGROUND OF THE INVENTION

1. Field of the invention

The present invention relates to industrial polyester fibers useful as reinforcements for rubber articles such as tires and belts. More particularly, the present invention relates to industrial polyester fibers, which are of high tenacity as well as of high modulus and low shrinkage, useful for the production of dipped cords (D/C) with superior dimensional stability. Also, the pre sent invention is concerned with a method for preparing such an industrial polyester fiber.

2. Description of the Prior Art

At present, widely used as reinforcements for rubber articles, such as tires and belts, are HMLS (high modulus low shrinkage) dipped cords which range, in E-S (intermediate elongation+shrinkage), from 6.5 to 8.0% with high dimensional stability. Generally, the grey yarns for these dipped cords are prepared by extruding molten polyester polymers, winding the extruded polyester polymers at a speed of 2,000 m/min or higher to produce a birefringence of at least $40\times10^{-3}$ in the resulting undrawn yarns, and drawing the undrawn yarns with the aid of a godet roller.

Since the first introduction of polyester grey fibers, characteristic of low shrinkage, low work loss, and high tenacity, in U.S. Pat. No. 4,101,525 (Davis, et al), references directed to industrial HMLS polyester fibers are found in many patents.

U.S. Pat. No. 4,491,657, for example, discloses a polyester multifilament yarn which has high modulus and low shrinkage and is useful in the textile reinforcement of tires, asserting that an improvement in tenacity can be brought about in twisted yarns and dipped cords when HMLS polyester multifilament yarns have a low terminal modulus. Since such a low terminal modulus demands lowering the draw ratio, it is needed to control the terminal modulus to a level in which the high tenacity of grey yarns can be appropriately expressed in order to produce high tenacity dipped cords.

In order to make industrial polyester grey yarns of high tenacity, conventionally, a heater is used to heat the temperature just below a spinning nozzle to lower the undrawn orientation of the yarns, followed by drawing at a high draw ratio. Alternatively, the grey yarns are spun at a low speed to lower the undrawn orientation and then, drawn at a high draw ratio. These conventional methods, however, cause an increase in shrinkage index, deteriorating the dimensional stability of final dipped cords. In addition, these conventional methods suffer from a disadvantage in that the yarns obtained are lowered in tenacity after undergoing the thermal treatment for twisted yarns.

Another reference concerning industrial HMLS polyester fibers is found in U.S. Pat. No. 4,690,866, which discloses that polyester chips with an intrinsic viscosity of at least 1.2 are spun to produce high tenacity HMLS grey yarns. Where the intrinsic viscosity of chips is increased, an increase occurs in the spinning tension of yarns and thus also in their orientation, giving contribution to the dimensional stability of the resulting dipped cords. In a view of the molecular structure of grey yarns, tie chains, which connect non-crystalline moieties with crystalline moieties, are formed at a large amount owing to the increase in the intrinsic viscosity of chips, so that the grey yarns show high tenacity even after being drawn at low draw ratios. The increase in the intrinsic viscosity of polyester chips is usually achieved by solid-polymerization.

Upon the solid-polymerization, however, the difference in intrinsic viscosity between chip surface and chip center is more serious as the viscosity becomes higher. Thus, the resulting inhomogeneous viscosity over the polymer incurs a decrease in spinning property and requires high temperatures upon melt-spinning. In turn, the high melting temperature promotes thermal decomposition and hydrolysis in the polymer. Therefore, the intrinsic viscosity of the filaments spun is not increased to the extent to which the viscosity of chips is increased. In practice, the intrinsic viscosity of chips is increased over the theoretical values in order for the yarns to obtain a desired viscosity. Particularly, the inhomogeneity of viscosity over the polymer causes yarns to frequently undergo filament cutting, making the appearance of and processability for yarns poor. In result, this conventional technique is economically disadvantageous in terms of time and energy.

In producing HMLS fibers, oiling is usually conducted to provide smoothness and packability for grey yarns. Oiling agents used for the oiling process are largely divided into two types: non-aqueous oiling agents and aqueous oiling agents. For non-aqueous oiling agents, crude oiling agents are mixed with mineral oil agents (straight oil) or used as they are (neat-oil). Non-aqueous oiling agents assure good processability, but are insufficient in safety, for example, apt to catch fire during processing. In addition, non-aqueous oiling agents are economically unfavorable in that they require additional heating means to maintain their appropriate viscosity and are expensive. On the other hand, aqueous oiling agents are good in safety and economic aspects compared with the non-aqueous oiling agents, but problematic in processability. Particularly, aqueous oiling agents are not suitable for high speed, direct spin-drawing processes. Therefore, there remains a need for an aqueous oiling agent which can be used for high speed, direct spin-drawing processes without complications.

SUMMARY OF THE INVENTION

Therefore, it is an object of the present invention to overcome the above problems encountered in prior arts and to provide an industrial polyester fiber, which is superior in spinning workability and physical properties and can be produced into dipped cords of high tenacity and low shrinkage.

It is another object of the present invention to provide a method for preparing an industrial polyester fiber, in which an aqueous oiling agent can be used for high speed, direct spin-drawing processes without deterioration of processability, but with high stability and economical profits.

It is a further object of the present invention to provide a method for preparing an industrial polyester fiber, in which a remarkable improvement can be brought into the drawing workability and the appearance of grey yarns at high draw ratios by reducing the discharge difference between spinning orifices and thus, the denier difference between the monofilaments of the grey yarns and by filtering impurities off out of polymers in a pack before spinning.

In one aspect of the present invention, there is provided a method for preparing an industrial fiber, comprising the steps of producing polyester chips through the solid-polymerization of polyester low chips comprising an antimony compound at a residual content of 200–400 ppm as calculated by antimony metal, the polyester chips ranging, in intrinsic viscosity, from 1.00 to 1.15 with a moisture content of 30 ppm or less; melt-spinning the polyester chips through a nozzle contained within a pack, wherein said polyester chips were melted at a temperature of 290–300° C. and extruded to conduits of polymer dispersing plates, each conduit having a static mixer composed of at least three units; oiling the filaments released from the nozzle, at an O.P.U. (Oil Pick Up) of 0.3–0.8% with a 10–30%, aqueous emulsion oiling agent prepared from a raw solution which comprises dialkyl-thio-diester, and fatty acid monoester or alkyl alkylate at an amount of 50 weight % or greater with the dialkyl-thio-diester amounting to at least 30 weight % of the raw solution, the oiling agent functioning as a lubricating agent; taking up the multifilament yarn at a speed of 2,000–3,300 m/min to obtain undrawn yarn ranging, in intrinsic viscosity, from 0.95 to 1.02 and, in orientation degree, from $40\times10^{-3}$ to $90\times10^{-3}$; and continuously drawing the undrawn yarn. In one embodiment, the polymers are filtered through at least three sheets of filters within the pack after being melted and before being extruded to the conduits. In another embodiment, the filaments are allowed to pass through a distance of 140–220 mm from the nozzle to a quenching zone, which is maintained at 200–250° C. and through the quenching zone wherein the filaments are cooled by air blowing at a certain speed with a low temperature. In a further embodiment, the multifilament yarn is drawn in a three-step manner in which draw ratios are controlled and a final heat-setting roller has a temperature of 190–235° C.

In another aspect, there is provided an industrial polyester fiber, having an intrinsic viscosity from 0.95 to 1.02, a tenacity from 6.5 to 9.3 g/d, an elongation from 11.0 to 18.0%, an amorphous orientation function (fa) from 0.70 to 0.80, a shrinkage from 4.0 to 7.5%, an initial modulus (Mi) from 90 to 120 g/d, a terminal modulus (Mt) from 5 to 70 g/d, a crystallinity from 40 to 51%, and a crystal size from 36 to 45 Å.

In a further aspect, there is provided a polyester dipped cord, having a tenacity of 6.3 g/d or greater, and a sum of intermediate elongation and shrinkage from 6.0 to 8.0%, which is prepared by subjecting two plies of the industrial polyester fibers to first twisting and second twisting, respectively, and dipping the twisted fibers.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a schematic view illustrating a process flow of preparing industrial polyester fibers, according to the present invention; and FIG. 2 is a schematic view illustrating a spinning pack in which a static mixer is installed, according to the present invention.

DETAILED DESCRIPTION OF THE PREFERRED EMBODIMENTS

To be useful as a reinforcement for dipped cords of high tenacity and thermal stability, polyester fibers must have superior physical properties, especially, high tenacity, high modulus and low shrinkage. To this end, first, polymer low chips are solid-polymerized without a significant increase in intrinsic viscosity and melt-extruded at a low temperature. After being filtered, the extrudate is melt-spun at a spinning speed of 2,000–3,300 m/min to give undrawn filaments with a fineness of 2–5 deniers per monofilament and a birefringence of $40\times10^{-3}$–$90\times10^{-3}$, which are then oiled with an aqueous emulsion oiling agent. The multifilament yarns thus obtained are subjected to multi-step drawing at a heat setting temperature of 190–235° C. to produce drawn yarns.

A detailed description will be given of the present invention in conjunction with the drawings.

With reference to FIG. 1, there is illustrated a processing procedure of preparing industrial polyester fibers, according to the present invention.

In one aspect, polyester chips used in the present invention are produced through solid-polymerization in the presence of an antimony compound as a polymerization catalyst. This catalyst is used at such an amount that the antimony metal ranges, in residual content, from 200 to 400 ppm. The polyester chips have an intrinsic viscosity of 1.00–1.15 and a moisture content of at most 30 ppm. The polyester chips are melted and then, maintained at a temperature of 290–300° C. before melt-spinning. These low temperatures have an effect of restraining, to a maximal extent, the viscosity reduction which is attributable to the thermal decomposition and hydrolysis of polymers during spinning. After the polymers are spun through a pack 1 and a nozzle 2, the resulting filaments 4 have an intrinsic viscosity from 0.95 to 1.02.

The spun filaments 4 are allowed to pass a hood length L between the nozzle 2 and a quenching zone 3, without additional heating means and then, quenched in the quenching zone 3. These filaments are oiled at O.P.U (Oil Pick Up) of 0.3–0.8% with the aid of oiling means 5. Functioning as a lubricating agent, the oiling agent used in the present invention is a 10–30% aqueous emulsion agent prepared from a raw solution which comprises dialkyl-thio-diester, and fatty acid monoester or alkyl alkylate at an amount of 50 weight % or greater with the dialkyl-thio-diester amounting to at least 30 weight % of the raw solution. Optionally, the oiling agent of the present invention may comprise an emulsifying agent such as polyoxyalkyl-alkyl-ether or polyoxyethylene-polyol, an antistatic agent, a polymer activating agent, and an antioxidant. The aqueous emulsion oiling agent, a characteristic of the present invention, enjoys an advantage of providing good processability, surmounting the problems caused by the conventional aqueous oiling agent.

After completion of the oiling, the resulting yarn is wound at a speed of 2,000–3,300 m/min so as to control the orientation degree of the undrawn yarn in the range of $40$–$90\times10^{-3}$, after which the undrawn yarn is drawn in three steps while passing through five pairs of godet rollers 6 to 10, to produce a grey yarn 11 with a fineness of 2–5 deniers per filament.

Optionally, in order to ameliorate the physical properties of the yarn, an epoxy compound is added to the surface of the yarn just before it is taken up.

As mentioned above, the polyester chips used in the present invention preferably have a moisture content of 30 ppm or less. For example, when the moisture content is over 30 ppm, hydrolysis occurs too much during the spinning, leading to reducing the intrinsic viscosity of the finally obtained yarn which therefore lacks in tenacity. Also, the intrinsic viscosity of the polymer chips is preferably within the range of 1.00–1.15. For example, when the intrinsic viscosity is larger than 1.15, too great a spinning tension is produced upon the low temperature spinning, along with frequent occurrence of filament cuts on account of irregular cross sections of the filaments spun. Thus, the workability of the spin-drawing process becomes poor.

In the present invention, only antimony-based compounds are used as a polymerization catalyst for the polyester chips.

The amount of the antimony catalyst is preferably within such a range that the residual content of the catalyst in the polymer ranges from 200 to 400 ppm. For example, when the antimony compound is used at an amount less than 200 ppm, the polymerization becomes poor in rate and thus, in efficiency. On the other hand, when the antimony compound is over 400 ppm, problems in workability occur. For instance, the catalyst is apt to be deposited after the polymerization, increasing the pack pressure and accelerating the contamination of the nozzle. Addition manners for the antimony catalyst are not limited unless specifically described.

In order to remove impurities from the polymer in the pack, conventionally, a filter is used in the pack which is filled with metal powder or sand. In the present invention, only one filter (at least three sheets of screen filters with 300 mesh or greater) is used. The absence of the metal powder or sand is found to reduce the difference in discharge between spinning orifices as well as in denier between monofilaments in a grey yarn, so the filaments show improved drawability which is directly relevant to the appearance of the grey yarn obtained after drawing at high draw ratios.

In this regard, a detail is given of the filtration with reference to FIG. 2 which shows a structure of a spinning pack in which a static mixer is installed, in accordance with the present invention.

The conventional filtration method in which the polymer is filtered through a filter in the pack filled with metal powder or sand, suffers from a significant disadvantage for the following reason: a metal powder or sand layer flows on an upper dispersing plate 13, making a filtering layer 16 non-uniform in height. This unstable filtering layer deleteriously affects the fluidity of the polymer which is passing through each conduit 14 of the upper dispersing plate 13, so that there occurs a difference in discharge between the spinning orifices, causing a fineness difference between the monofilaments.

Use of a filter alone, as in the present invention, brings about a significant improvement in the uniformness of the height of the filtering layer, compared with the conventional technique which employs a metal powder or sand layer. It was found that the reduction of the discharge difference between the spinning orifices, effected by the uniform height of the filtering layer, resulted in reducing the fineness difference between monofilaments from 7–10% to 6% or less in terms of coefficient of variation (CV). An elaboration allowed the reduction of the coefficient of variation in fineness difference between monofilaments to 4% or less.

When the screen filters used in the present invention are two or less in number or smaller in size than 300 mesh, impurities can pass the screen filters freely, deteriorating the drawability and appearance of the grey yarn.

In accordance with the present invention, a pack 1 installed in the spinner is specialized as shown in FIG. 2. As seen, the pack 1 on a nozzle 2 comprises a body 12, an upper dispersing plate 13, and a lower dispersing plate 15. Before being extruded through the nozzle 2, a polymer melt is introduced into the pack 1. In the pack 1, the melt is filtered through a filtering layer 16 and then, allowed to enter a polymer conduit 14 having a static mixer composed of at least three units within the upper dispersing plate 13. While passing through the polymer conduit, the polymer melt is homogeneously mixed by the action of the static mixer to make the melt viscosity of the polymer homogeneous, thereby improving the spinning workability. Where no static mixers are installed, the spinning workability is deteriorated with frequent occurrence of filament cuts. The static mixer is provided within the conduits through which the polymer flows after being filtered through the sand layer 16. Three or more units of the static mixer should be provided in each conduit. For example, if the static mixer has two or less units, the polymer melt is not well homogeneously mixed so that undesirable effects are brought into the spinning workability and the appearance of the grey yarn.

Returning now to FIG. 1, no heating means is provided just below the nozzle 2 as described above. Instead of being heated to a melting temperature or higher, the filaments released just below the nozzle are allowed to move the hood length L from the nozzle 2 to the quenching zone 3, as they are. Therefore, the filaments released just below the nozzle 2 are maintained at a temperature of 200 to 250° C. and cooled as soon as possible to increase their solidification temperature when they are released from the nozzle 2. The hood length L is preferably controlled in the range of 140 to 220 mm.

The low temperature in the atmosphere just below the nozzle increases the solidification point as well as spinning tension of the polymer spun, bringing about an improvement in the tie chain formation and undrawn orientation of the filaments, thereby producing grey yarns superior in tenacity and dimensional stability.

In order to prepare HMLS polyester grey yarns of superb physical properties by changing fineness per monofilament, temperatures of heat set rollers, and draw ratios, undrawn yarns preferably range, in orientation degree, from $40\times10^{-3}$ to $90\times10^{-3}$. For example, when the undrawn yarns have an orientation degree of less than $40\times10^{-3}$, a large reduction is brought about in tenacity when dip thermal treatment and increased E-S are provided for the dipped cords which are finally poor in thermal stability. On the other hand, an orientation degree greater than $90\times10^{-3}$ makes the workable, maximal draw ratio too low to sufficiently raise the tenacity of the grey yarns.

The industrial polyester fibers prepared in accordance with the present invention have the following physical properties: an intrinsic viscosity of 0. 95–1.02, an amorphous orientation coefficient (fa) of 0.70–0.80, an initial modulus (Mi) of 90–120 g/d, a terminal modulus (Mt) of 5–70 g/d, a tenacity of 6.5–9.3 g/d, an elongation of 11.0–18.0%, a shrinkage index of 4.0–7.5%, a percent crystallinity of 40–51%, and a crystal size of 36–45 Å.

Particularly, when a terminal modulus is over 70 g/d, poor advantage is taken of the tenacity of the fibers and dipped cords. On the other hand, a terminal modulus of less than 5 g/d requires an increment in undrawn orientation, making it difficult for grey yarns to exhibit sufficient tenacity.

As described above, the industrial polyester fiber prepared according to the present invention has a high tenacity of 6.5 g/d or greater, and a sufficiently low shrinkage index as well as shows a small reduction in tenacity upon dip thermal treatment. Therefore, the dipped cords which are obtained by subjecting two plies of the industrial polyester fibers to first and second twisting, respectively, and dipping the twisted fibers in a rubber solution, followed by thermal treatment, enjoy advantages of being superior in tenacity and dimensional stability as demonstrated by a tenacity of 6.3 g/d or greater and an E-S (intermediate elongation+ shrinkage) of 6.0–8.0%, being useful as reinforcements for rubber products, such as tires and belts, and for other industrial applications.

A better understanding of the present invention may be obtained in light of the following examples which are set forth to illustrate, but are not to be construed to limit the present invention. Physical properties used in the following examples were measured as follows:

(1) Intrinsic Viscosity

A measurement was made of intrinsic viscosity, according to ASTM D4603-91. 0.1 g of a sample was dissolved in a mixed reagent comprising phenol and 1,1,2,2-tetrachloroethanol at a weight ratio of 6:4, for 90 min to give a solution at a concentration of 0.4 g of the sample per 100 ml of the reagent. This solution was transferred to an Ubbelohde viscometer and allowed to stand in a 30° C. incubator for 10 min. Using the viscometer and an aspirator, a measurement was made of the dropping time (sec) of the solution. The solvent and the sample were also measured for dropping time in seconds in the same manner. Based on the measured times, relative viscosity (R.V.) and intrinsic viscosity (I.V.) were calculated according to the following formulas.

$$R.V.=\text{Dropping Time of Sample}/\text{Dropping Time of Solvent}$$

$$I.V.=\tfrac{1}{4}\times(R.V.-1/C)+\tfrac{3}{4}\times(\ln R.V./C)$$

where C=density (g/100 ml).

(2) Tenacity and Elongation of Drawn fiber and Dipped Cord

Under a standard condition (20° C., 65% RH), samples 250 mm in length were measured at a tensile speed of 300 mm/min 80 TPM.

(3) Initial Modulus (Mi)

There was used the gradient of a tangent line which was drawn at an initial part of an S-S curve obtained in a tensile test.

(4) Terminal Modulus

On an S—S curve of a sample fiber, an increment in tenacity (ΔT(g/d)) between a point of elongation at break (E(%)) and a point of elongation, which corresponds to 2.4% subtraction from the elongation at break (E-2.4) was obtained. This increment was divided by 0.024.

(5) Crystallinity (Xc)

It was determined from the following equation after density (ρ) of sample was obtained using a density gradient tube:

$$Xc\ (\%)=\rho c/\rho\times(\rho-\rho a)/(\rho c-\rho a)$$

where ρ=density of sample (g/cm$^3$),

ρc=density of crystal (1.455 g/cm$^3$)

ρa=density of amorphous (1.335 g/cm$^3$).

(6) Size of Crystal

It was determined according to the following formula, based on the analysis of (100) diffraction peaks from a diffraction pattern obtained by wide-angle diffractometry using an X-ray with a wavelength of λ (1.5428 Å).

$$\text{Crystal Size}=K\lambda/\beta\cos\theta$$

where K=Scherrer constant,

λ=X-ray wavelength (1.5428 Å)

β=half width

θ=Bragg angle.

(7) Amorphous Orientation Function (fa)

It was calculated from the following equation:

$$fa=\Delta n-fc\cdot Xc\cdot\Delta nc/(1-Xc)\cdot\Delta na$$

where Δn=bireferingence fc=crystal orientation function

Xc=crystallinity

Δnc=intrinsic birefringence of crystal (0.220)

Δna=intrinsic birefringence of amorphous (0.275).

(8) Shrinkage

The value (ΔS) was calculated from the following equation wherein Lo was the length of a sample measured under a load corresponding to 0.1 g/d after it had been placed at 25° C. 65% RH during24 hours, and L was the length after it had been placed in an oven at 150° C. during 30 min and allowed to stand for 4 hours under zero load $$\Delta S(\%)=(Lo-L)/Lo\times100$$

(9) Intermediate Elongation

On a tenacity-elongation S—S curve of a sample, it was determined as the elongation measured under a load of 4.5 g/d for grey yarns and as the elongation measured under a load of 2.25 g/d for dipped cords. (10) E+S It was determined as a sum of intermediate elongation and shrinkage.

EXAMPLES I TO IV AND COMPARATIVE EXAMPLES I TO VI

Polyester low chips with an intrinsic viscosity of 0.65, in which an antimony compound, functioning as a polymerization catalyst, was added at a residual content of 320 ppm as calculated by antimony metal, were subjected to solid-polymerization at 220° C. under vacuum to give polyester chips which were 1.06 in intrinsic viscosity and 20 ppm in moisture content. These polyester chips were melt-extruded using an extruder, followed by passing the melt through spinning conduits. Then, the melt was allowed to go through a pack having a static mixer composed of five units every conduit, and spun at a discharge of 500–600 g/min through a nozzle.

After passing an unheated hood length of 150 mm just below the nozzle, the filaments spun were solidified by blowing quenching air maintained at 19° C. over the filaments at a speed of 0.5 m/sec along a quenching zone 530 mm long. Thereafter, the filaments were directed to an oiling roller in which an aqueous emulsion oiling agent composed of one of the compositions indicated in Table 1, was applied to the filaments. The resulting undrawn fiber was taken up at a speed of 2,100 m/min by a godet roller, subjected to three-step drawing by use of other godet rollers, provided with 2% relax, and wound to give grey yarns with 1,000 deniers/249 filaments.

Two plies of the grey yarns were subjected to first twisting and second twisting, respectively, at 470 TPM and dipped in resorcinol formalin latex (RFL), followed by thermal treatment at 240° C. to give dipped cords. The physical properties of the grey yarns and dipped cords were evaluated according to the oiling agents and are summarized in Table 2, below.

TABLE 1

| Kind | Lubricating Agents | Emulsifying Agents | Others |
|---|---|---|---|
| A | Dialkyl-thio-diester 55%<br>Alkyl alkylate 6% | Polyoxyalkylene-alkyl-ether 17%<br>POE-polyol 15% | Antioxidant<br>Polymer<br>Activator 7% |
| B | Dialkyl-thio-diester 20%<br>Alkyl alkylate 40% | Polyoxyalkylene-alkyl-ether 20%<br>POE-polyol 13% | Antioxidant<br>Polymer<br>Activator 7% |

TABLE 1-continued

| Kind | Lubricating Agents | Emulsifying Agents | Others |
|---|---|---|---|
| C | Oleyl-oleate 50% | POE-caster oil-tristearate 27%<br>POE-solvitan-tristearate 11%<br>Oleic acid-monoglyceride 6% | Antioxidant<br>Polymer<br>Activator 6% |

TABLE 1-continued

| Kind | Lubricating Agents | Emulsifying Agents | Others |
|---|---|---|---|
| D | Dialkyl-thio-diester 33%<br>Fatty acid monoester 20% | POE-hydrogenated caster oil 33%<br>Polypropylene glycol 8%<br>POE-alkyl amine 3.5% | Antistatic agent<br>Antioxidant 2.5% |
| E | Dialkyl-thio-diester 15%<br>Fatty acid monoester 38% | The same with D | the same with D |

TABLE 2

Physical Properties and Workability According to Oiling Agents

| No. of Exampl | Filam. I.V. | Total Draw Ratio | Oiling Agent | Conc. Of Aqueous Emulsion (%) | Grey yarn OPU Level (%) | Grey yarn Tenacity (g/d) | Grey yarn Elong. (%) | Grey yarn Shrink. (%) | Grey yarn Mi (g/d) | Grey yarn Mt (g/d) | Grey yarn Xc (%) | Grey yarn No. of Appear. mow* | Dipped Cord Tenacity (g/d) | Dipped Cord E (%) | Dipped Cord Shrink. (%) | Dipped Cord E-S (%) | Note |
|---|---|---|---|---|---|---|---|---|---|---|---|---|---|---|---|---|---|
| C.I | 0.98 | 2.24 | C | 15 | 0.45 | 8.3 | 12.5 | 5.6 | 95.6 | 18 | 48.5 | 8 | 6.0 | 3.8 | 3.8 | 7.6 | Poor appear. of grey yarn Poor tenacity of dipped Cord |
| C.II | 0.98 | 2.23 | C | 20 | 0.55 | 8.4 | 12.8 | 5.4 | 95.8 | 19 | 48.4 | 5 | 6.2 | 3.8 | 3.6 | 7.4 | Poor appear. of grey yarn Poor tenacity of dipped Cord |
| C.III | 0.98 | 2.29 | B | 15 | 0.47 | 8.7 | 12.6 | 6.2 | 104.3 | 23 | 48.2 | 3 | 6.5 | 3.6 | 3.9 | 7.5 | Poor appearance of grey yarn |
| C.IV | 0.98 | 2.28 | B | 20 | 0.54 | 8.5 | 12.7 | 6.1 | 104.5 | 25 | 48.0 | 3 | 6.4 | 3.5 | 3.9 | 7.4 | Poor appearance of grey yarn |
| C.V | 0.98 | 2.28 | E | 15 | 0.45 | 8.6 | 12.1 | 6.1 | 106.5 | 33 | 49.5 | 6 | 6.6 | 3.5 | 4.2 | 7.7 | Poor appearance of grey yarn |
| C.VI | 0.98 | 2.30 | E | 20 | 0.56 | 8.4 | 12.4 | 6.1 | 104.5 | 32 | 49.5 | 5 | 6.4 | 3.7 | 4.2 | 7.9 | Poor appearance of grey yarn |
| I | 0.98 | 2.36 | A | 15 | 0.50 | 9.2 | 12.5 | 6.5 | 114.5 | 33 | 48.3 | 0 | 6.9 | 3.5 | 4.2 | 7.7 | |
| II | 0.98 | 2.38 | A | 20 | 0.62 | 9.0 | 12.3 | 6.7 | 112.5 | 35 | 48.5 | 1 | 6.8 | 3.5 | 4.3 | 7.8 | |
| III | 0.98 | 2.38 | D | 15 | 0.50 | 9.2 | 12.4 | 6.3 | 112.5 | 31 | 50.4 | 1 | 7.0 | 3.4 | 4.5 | 7.9 | |
| IV | 0.98 | 2.39 | D | 20 | 0.65 | 9.1 | 12.6 | 6.5 | 110.4 | 30 | 49.5 | 0 | 6.8 | 3.4 | 4.4 | 7.8 | |

*Average numbers of appearance mows of 10 kg cake (if 2 or more, disqualified)

EXAMPLES V TO VIII AND COMPARATIVE EXAMPLES VII TO XX

Polyester low chips with an intrinsic viscosity of 0.65, in which an antimony compound, functioning as a polymerization catalyst, was added at a residual content of 320 ppm as calculated by antimony metal, were subjected to solid-polymerization to give polyester chips which had a moisture content of 20 ppm and intrinsic viscosities indicated in Table 3, below. These polyester chips were melt-extruded using an extruder, followed by passing the melt through spinning conduits. Then, the melt was allowed to go through a pack having a static mixer composed of five units every conduit, and spun at a discharge of 500–600 g/min through a nozzle.

After passing an unheated hood length of 170 mm just below the nozzle, the filaments spun were solidified by blowing quenching air maintained at 20° C. over the filaments at a speed of 0.5 m/sec along a quenching zone 530 mm long. Thereafter, the filaments were directed to an oiling roller in which an aqueous emulsion oiling agent composed of one of the compositions indicated in Table 1, was applied to the filaments. The resulting undrawn fiber was taken up at a speed of 2,100 m/min by a godet roller, subjected to three-step drawing by use of other godet rollers, provided with 2% relax, and wound to give grey yarns with 1,000 deniers/249 filaments (a fineness of about 4 per monofilament).

Dipped cords were prepared in the same manner as that of Example I, and the physical properties of the grey yarns and dipped cords were evaluated according to the oiling agents and are summarized in Table 3, below.

TABLE 3

| | | | | | Physical Properties and Workability | | | | | | | | | | | | |
|---|---|---|---|---|---|---|---|---|---|---|---|---|---|---|---|---|---|
| | | | | | Grey Yarn | | | | | | | | Dipped Cord | | | | |
| Nos. of Exmpl. | Chip I.V. | Temp. Of Spin Beam (° C.) | Filam. I.V. | Total Draw Ratio | Tenacity (g/d) | Elong. (%) | Mi (g/d) | Mt (g/d) | Shrink. (%) | Xc (%) | Crystal size (Å) | fa | Tenacity (g/d) | E (%) | Shrink. (%) | E-S (%) | Note |
| C.VII | 1.00 | 280 | — | — | — | — | — | — | — | — | — | — | — | — | — | — | Working impossible |
| C.VIII | 1.00 | 290 | 0.92 | 2.29 | 8.9 | 11.3 | 98 | 21 | 6.7 | 47.1 | 37 | 0.780 | 6.60 | 3.7 | 3.8 | 7.5 | Poor tenacity in D/C |
| C.IX | 1.00 | 300 | 0.89 | 2.33 | 8.9 | 11.2 | 101 | 27 | 7.3 | 47.4 | 35 | 0.805 | 6.47 | 3.7 | 4.0 | 7.7 | |
| C.X | 1.00 | 310 | 0.87 | 2.38 | 9.0 | 11.6 | 105 | 30 | 8.0 | 47.6 | 36 | 0.8333 | 6.43 | 3.6 | 4.1 | 7.7 | |
| V | 1.10 | 290 | 1.00 | 2.21 | 9.1 | 11.8 | 107 | 28 | 6.4 | 47.5 | 38 | 0.771 | 6.95 | 3.5 | 4.0 | 7.5 | |
| VI | 1.10 | 300 | 0.97 | 2.25 | 8.9 | 11.7 | 103 | 32 | 7.0 | 47.1 | 37 | 0.795 | 6.82 | 3.6 | 4.1 | 7.7 | |
| C.XI | 1.10 | 280 | — | — | — | — | — | — | — | — | — | — | — | — | — | — | Working impossible |
| C.XII | 1.10 | 305 | 0.97 | 2.45 | 9.4 | 10.2 | 106 | 72 | 8.3 | 45.1 | 36 | 0.805 | 6.75 | 3.4 | 5.0 | 8.4 | Poor tenacity in D/C High E-S |
| C.XIII | 1.10 | 310 | 0.94 | 2.30 | 8.8 | 12.0 | 98 | 36 | 7.8 | 46.5 | 35 | 0.805 | 6.56 | 3.5 | 4.6 | 8.1 | Poor tenacity in D/C High E-S |
| C.XIV | 1.15 | 310 | 0.99 | 2.35 | −9.4 | 10.5 | 108 | 75 | 8.2 | 48.6 | 40 | 0.800 | 6.9 | 3.5 | 4.7 | 8.2 | Poor tenacity in D/C High E-S |
| C.XV | 1.15 | 280 | — | — | — | — | — | — | — | — | — | — | — | — | — | — | Working impossible |
| VII | 1.15 | 290 | 1.01 | 2.17 | 8.8 | 12.1 | 105 | 22 | 6.1 | 50.2 | 43 | 0.769 | 6.91 | 3.5 | 3.9 | 7.4 | — |
| VIII | 1.15 | 300 | 0.99 | 2.21 | 9.0 | 12.0 | 108 | 27 | 6.7 | 49.7 | 41 | 0.779 | 6.95 | 3.5 | 4.0 | 7.5 | — |
| C.XVI | 1.15 | 305 | 0.97 | 2.24 | 9.1 | 11.8 | 111 | 33 | 7.2 | 50.1 | 38 | 0.805 | 7.00 | 3.6 | 4.6 | 8.2 | High E-S |
| C.XVII | 1.15 | 315 | 0.94 | 2.29 | 9.1 | 11.5 | 113 | 37 | 7.5 | 49.9 | 37 | 0.820 | 6.91 | 3.6 | 4.8 | 8.4 | High E-S |
| C.XVIII | 1.20 | 290 | — | — | — | — | — | — | — | — | — | — | — | — | — | — | Working impossible |
| C.XIX | 1.20 | 300 | — | — | — | — | — | — | — | — | — | — | — | — | — | — | Working impossible |
| C.XX | 1.20 | 310 | 1.17 | 2.17 | 8.6 | 13.2 | 96 | 29 | 6.8 | 50.3 | 38 | 0.767 | 6.69 | 3.7 | 4.1 | 7.8 | Poor tenacity in grey yarn and D/C Working impossible |

EXAMPLES IX TO XI AND COMPARATIVE EXAMPLES XXI TO XXV

Polyester low chips with an intrinsic viscosity of 0.65, in which an antimony compound, functioning as a polymerization catalyst, was added at a residual content of 320 ppm as calculated by antimony metal, were subjected to solid-polymerization to give polyester chips which were 1.06 in intrinsic viscosity and 20 ppm in moisture content. These solid-polymerized polyester chips were melt-extruded at 295° C. using an extruder, followed by passing the melt through spinning conduits. Thereafter, the melt was spun at a discharge of 500–600 g/min through a nozzle under various conditions concerning the use of the static mixer and the length and temperature of the hood as indicated in Table 4, below.

After passing an unheated hood length of 150 mm just below the nozzle, the filaments spun were solidified by blowing quenching air maintained at 20° C. over the filaments at a speed of 0.5 m/sec along a quenching zone 530 mm long. Thereafter, the filaments were directed to an oiling roller in which an aqueous emulsion oiling agent composed of one of the compositions indicated in Table 1, was applied to the filaments. The resulting undrawn fiber was taken up at a speed of 2,100 m/min by a godet roller, subjected to three-step drawing by use of other godet rollers, provided with 2% relax, and wound to give grey yarns with 1,000 deniers/249 filaments (a fineness of about 4 per monofilament).

Dipped cords were prepared in the same manner as that of Example I, and the physical properties of the grey yarns and dipped cords were evaluated according to the oiling agents and are summarized in Table 4, below. As apparent from Table 4, when no static mixers were used, the resulting dipped cords and grey yarns became poor in tenacity and appearance, respectively. Even if static mixers were used, unsuitable hood length or temperature conditions also caused similar problems.

TABLE 4

Physical Properties and Workability

| Nos. of Exmpl. | [1]Hood Length (mm) | Filam. I.V. | [2]Hood Temp. (° C.) | Static Mixer in Pack | Orient. Degree of Undrawn Fiber | Total Draw Ratio | Grey yarn Tenacity (g/d) | Grey yarn Elong. (%) | Grey yarn Mi (g/d) | Grey yarn Mt (g/d) |
|---|---|---|---|---|---|---|---|---|---|---|
| C.XXI | 90 | 0.98 | — | ○ | 0.052 | — | — | — | — | — |
| C.XXII | 140 | " | 200 | X | 0.049 | 2.16 | 9.0 | 11.2 | 112 | 23 |
| IX | 140 | " | 200 | ○ | 0.048 | 2.16 | 8.9 | 11.7 | 109 | 22 |
| C.XXIII | 170 | " | 220 | X | 0.046 | 2.20 | 8.9 | 11.3 | 110 | 27 |
| X | 170 | " | 220 | ○ | 0.045 | 2.20 | 9.1 | 11.9 | 105 | 25 |
| C.XXIV | 220 | " | 240 | X | 0.042 | 2.27 | 9.0 | 11.6 | 103 | 32 |
| XI | 220 | " | 240 | ○ | 0.042 | 2.27 | 9.0 | 12.3 | 104 | 30 |
| C.XXV | 270 | " | 260 | ○ | 0.035 | 2.35 | 9.1 | 11.5 | 115 | 35 |

| Nos. of Exmpl. | Grey yarn Shrink. (%) | Grey yarn Xc (%) | Crystal Size (Å) | Crystal fa | Dipped Cord Tenacity (g/d) | Dipped Cord E (%) | Dipped Cord Shrink. (%) | Dipped Cord E-S (%) | Note |
|---|---|---|---|---|---|---|---|---|---|
| C.XXI | — | — | — | — | — | — | — | — | Working impossible |
| C.XXII | 6.1 | 52.7 | 45 | 0.760 | 6.73 | 3.5 | 3.7 | 7.2 | Poor tenacity in D/C Poor Appear. Of grey yarn |
| IX | 6.3 | 51.0 | 44 | 0.762 | 6.91 | 3.5 | 3.6 | 7.1 | — |
| C.XXIII | 6.4 | 50.7 | 42 | 0.776 | 6.69 | 3.5 | 3.9 | 7.4 | Poor Appear. Of grey yarn |
| X | 6.5 | 50.5 | 42 | 0.780 | 7.00 | 3.5 | 3.8 | 7.3 | — |
| C.XXIV | 6.7 | 50.1 | 39 | 0.791 | 6.78 | 3.5 | 4.0 | 7.5 | Poor Appear. Of grey yarn |
| XI | 6.8 | 49.9 | 38 | 0.795 | 6.91 | 3.5 | 4.0 | 7.5 | — |
| C.XXV | 7.2 | 49.8 | 36 | 0.821 | 6.78 | 3.6 | 4.7 | 8.3 | High E-S |

[1]distance from the bottom of nozzle to the upper part of quenching zone
[2]temperature measured at the point 100 mm distant from the bottom of nozzle

EXAMPLES XII TO XVI AND COMPARATIVE EXAMPLES XXVI TO XXVIII

Polyester low chips with an intrinsic viscosity of 0.65, in which an antimony compound, functioning as a polymerization catalyst, was added at a residual content of 320 ppm as calculated by antimony metal, were subjected to solid-polymerization to give polyester chips which were 1.06 in intrinsic viscosity and 20 ppm in moisture content. Using an extruder, these solid-polymerized polyester chips were melt-extruded at 295° C. through spinning conduits into a pack having a static mixer composed of five units every conduit. After being filtered through the pack, the polymers were spun at a discharge of 500–600 g/min through a nozzle.

Following the passage through an unheated hood zone which was 220 mm long with a temperature of 240° C. just below the nozzle and lacked separate heating means, the filaments spun were solidified by blowing quench air main tained at 20° C. over the filaments at a speed of 0.5 m/sec along a quenching zone 530 mm long. Thereafter, the filaments were directed to an oiling roller in which an aqueous emulsion oiling agent composed of one of the compositions indicated in Table 1, was applied to the filaments. The resulting undrawn fiber was taken up at different spinning speeds by a godet roller as indicated in Table 5, subjected to three-step drawing by use of other godet rollers, provided with 2% relax, and wound to give grey yarns with 1,000 deniers/249 filaments (a fineness of about 4 per monofilament).

Dipped cords were prepared in the same manner as that of Example I, and the physical properties of the grey yarns and dipped cords were evaluated and are summarized in Table 5, below.

TABLE 5

Physical Properties according to Spinning Speed

| Nos. of Exmpl. | Spinning Speed (m/min) | Orient. Degree of Undrawn Fiber | Total Draw Ratio | Nos. of Appear. Mows in Grey yarn | Grey Yarn Tenacity (g/d) | Elong. (%) | Mi (g/d) | Mt (g/d) | Shrink. (%) |
|---|---|---|---|---|---|---|---|---|---|
| C.XXVI | 1600 | 0.030 | 2.83 | 1 | 8.9 | 11.9 | 115 | 35 | 7.2 |
| C.XXVII | 1800 | 0.035 | 2.58 | 1 | 9.0 | 11.8 | 112 | 34 | 7.1 |
| XII | 2000 | 0.040 | 2.40 | 1 | 9.2 | 11.9 | 109 | 28 | 6.6 |
| XIII | 2400 | 0.048 | 2.15 | 0 | 8.9 | 11.7 | 104 | 22 | 6.5 |
| XIV | 2800 | 0.068 | 1.85 | 1 | 7.8 | 15.2 | 110.5 | 15 | 5.5 |
| XV | 3000 | 0.076 | 1.80 | 0 | 7.0 | 16.8 | 112.0 | 7 | 5.5 |
| XVI | 3200 | 0.090 | 1.7 | 0 | 6.8 | 17.8 | 112.5 | 5 | 4.7 |
| C.XXVIII | 3400 | 0.105 | 1.45 | 8 | 6.0 | 18.5 | 104.3 | 2 | 4.3 |

| Nos. of Exmpl. | Grey Yarn Crystal Xc (%) | Size (Å) | fa | Dipped Cord Tenacity (g/d) | E (%) | Shrink. (%) | E-S (%) | Note |
|---|---|---|---|---|---|---|---|---|
| C.XXVI | 49.3 | 35 | 0.82 | 6.56 | 3.5 | 4.7 | 8.2 | Poor tenacity in D/C High E-S |
| C.XXVII | 49.0 | 36 | 0.80 | 6.52 | 3.6 | 4.5 | 8.1 | Poor tenacity in D/C High E-S |
| XII | 50.2 | 38 | 0.78 | 6.91 | 3.5 | 4.0 | 7.5 | High E-S |
| XIII | 51.0 | 41 | 0.075 | 7.00 | 3.5 | 3.7 | 7.2 | |
| XIV | 46.8 | 45 | 0.73 | 6.7 | 3.2 | 3.5 | 6.7 | |
| XV | 45.0 | 47 | 0.73 | 6.5 | 3.2 | 3.3 | 6.5 | |
| XVI | 47.1 | 45 | 0.74 | 6.1 | 3.2 | 3.1 | 6.3 | |
| C.XXVIII | 43.4 | 46 | 0.072 | 5.8 | 3.2 | 3.3 | 6.5 | Poor Appear. Of Grey yarn Poor Tenacity in D/C |

EXAMPLES XVII TO XX AND COMPARATIVE EXAMPLES XXIX TO XXXIV

Polyester low chips with an intrinsic viscosity of 0.65, in which an antimony compound, functioning as a polymerization catalyst, was added at a residual content of 360 ppm as calculated by antimony metal, were subjected to solid-polymerization to give polyester chips which had a moisture content of 20 ppm and intrinsic viscosities indicated in Table 7, below. Using an extruder, these polyester chips were melt-extruded through spinning conduits into a pack. In the pack, the extrudates were filtered through the filtering materials and/or filters as shown in Table 6, below. Then, the filtrates were allowed to go through a pack having a static mixer composed of five units every conduit and spun through a nozzle at a discharge of 500–600 g/min for drawn yarns with 1,000 deniers and 800–900 g/min for drawn yarns with 1,500 deniers.

After passing an unheated hood length of 170 mm just below the nozzle, the filaments spun were solidified by blowing quench air maintained at 20° C. over the filaments at a speed of 0.5 m/sec along a quenching zone 530 mm long. Thereafter, the filaments were directed to an oiling roller in which an aqueous emulsion oiling agent composed of one of the compositions indicated in Table 1, was applied to the filaments. The resulting undrawn fiber was taken up at a speed of 2,400–3,200 m/min by a godet roller, subjected to three-step drawing by use of other godet rollers, provided with 2% relax, and wound to give grey yarns of 1,000 and 1,500 deniers with a fineness of 3–4 deniers per monofilament.

Dipped cords were prepared in the same manner as that of Example I, and the physical properties of the grey yarns and dipped cords were evaluated according to the filtration types and are summarized in Table 7, below.

TABLE 6

| | Filtering Materials | Filters |
|---|---|---|
| A | 10–20$\mu$ metal powder 300 g | 325 mesh filter (one ply) |
| B | 10–20$\mu$ metal powder 400 g | 325 mesh filter (one ply) |
| C | — | 200 mesh filter (three plies) |
| D | — | 325 mesh filter (three plies) |

TABLE 7

Physical Properties and Workability

| | Grey yarn | | | | | Grey Yarn | | | | | | | |
|---|---|---|---|---|---|---|---|---|---|---|---|---|---|
| Nos. of Exmpl. | Chip I.V. | (denier/ filament) | Spinning Speed | Filter | Draw Ratio | Tenacity (g/d) | Elong. (%) | Mi (g/d) | Mt (g/d) | Shrink. (%) | Xc | Size (Å) | fa |
| C.XXIX | 1.05 | 1000/328 | 2400 | A | 2.2 | 8.7 | 12.1 | 104.5 | 65 | 7.5 | 41.0 | 38 | 0.79 |
| C.XXX | 1.05 | 1000/328 | 2400 | B | 2.2 | 8.7 | 12.2 | 104.0 | 63 | 7.5 | 40.0 | 37 | 0.79 |
| C.XXXI | 1.05 | 1000/328 | 2400 | C | 2.2 | 8.8 | 12.3 | 104.0 | 65 | 7.8 | 39.5 | 38 | 0.78 |
| XVII | 1.05 | 1000/328 | 2400 | D | 2.2 | 9.0 | 12.2 | 104.0 | 65 | 7.6 | 39.5 | 39 | 0.78 |
| XVIII | 1.05 | 1000/328 | 2400 | D | 2.2 | 9.0 | 12.3 | 104.0 | 64 | 7.6 | 40.0 | 38 | 0.79 |
| C.XXXII | 1.14 | 1500/384 | 2100 | A | 2.4 | 9.2 | 10.5 | 104.0 | 67 | 8.0 | 41.0 | 38 | 0.79 |
| C.XXXIII | 1.14 | 1500/384 | 2100 | B | 2.4 | 9.2 | 10.3 | 104.0 | 68 | 7.9 | 42.0 | 39 | 0.80 |
| C.XXXIV | 1.14 | 1500/384 | 2100 | C | 2.4 | 9.2 | 10.5 | 104.5 | 69 | 7.9 | 41.0 | 38 | 0.80 |
| XIX | 1.14 | 1500/384 | 2100 | D | 2.4 | 9.3 | 10.7 | 104.5 | 68 | 7.8 | 40.5 | 38 | 0.80 |
| XX | 1.14 | 1500/384 | 2100 | D | 2.4 | 9.3 | 10.8 | 104.5 | 67 | 7.8 | 41.0 | 39 | 0.80 |

| | Grey Yarn | | | | | | | | |
|---|---|---|---|---|---|---|---|---|---|
| | Staple | | | | Dipped Cord | | | | |
| Nos. of Exmpl. | Avg. diameter ($\mu$) | Mean Deviation | CV (%) | No. of Apper. Mow in Grey Yarn | Tenacity (g/d) | E (%) | Shrink. (%) | E-S (%) | Note |
| C.XXIX | 19.5 | 1.4 | 7.2 | 8 | 6.71 | 3.5 | 3.9 | 7.4 | Poor appear. Of Grey Yarn |
| C.XXX | 19.4 | 1.5 | 7.7 | 5 | 6.72 | 3.6 | 3.9 | 7.5 | Poor appear. Of Grey Yarn |
| C.XXXI | 19.4 | 1.0 | 5.1 | 3 | 6.82 | 3.6 | 3.9 | 7.5 | Poor appear. Of Grey Yarn |
| XVII | 19.3 | 1.0 | 5.2 | 1 | 7.02 | 3.5 | 3.9 | 7.4 | |
| XVIII | 19.4 | 0.8 | 4.1 | 0 | 7.12 | 3.5 | 3.9 | 7.4 | |
| C.XXXII | 22.5 | 1.8 | 8.0 | 12 | 6.81 | 3.5 | 4.0 | 7.5 | Poor appear. Of Grey Yarn |
| C.XXXIII | 21.9 | 1.6 | 7.3 | 10 | 6.91 | 3.6 | 4.1 | 7.7 | Poor appear. Of Grey Yarn |
| C.XXXIV | 21.7 | 1.3 | 6.0 | 4 | 7.05 | 3.5 | 4.2 | 7.7 | Poor appear. Of Grey Yarn |
| XIX | 21.5 | 1.2 | 5.6 | 2 | 7.10 | 3.3 | 4.2 | 7.5 | |
| XX | 21.7 | 1.1 | 4.6 | 1 | 7.15 | 3.3 | 4.2 | 7.7 | |

As described hereinbefore, the present invention is characterized in that low temperature spinning is possible, making it unnecessary to raise the intrinsic viscosity of chips to the state capable of spinning. Accordingly, a reduction can be brought about in the period of time and energy which are necessary for the solid-polymerization of the chips. Particularly, the difference in intrinsic viscosity between chip surface and chip center, a significant problem caused by solid-polymerization, is also reduced, so that the improved homogeneity of viscosity throughout the chip entity can be achieved, resulting in a great advance in workability and the physical properties of the fibers obtained. In addition, use of filters alone in removing impurities from polymers reduces the difference in discharge between spinning orifices and thus, in denier between the monofilaments of grey yarns. In this regard, the polymers are filtered through at least three sheets of the filters with at least 300 mesh. In result, the yarns are improved in drawability, so that they have excellent appearance even after being drawn at high draw ratios.

Also, the present invention is characterized in that the industrial polyester fibers, even if prepared at relatively low draw ratios, have high tenacity. To this end, first, a static mixer is installed in a pack ahead of a nozzle, so that polymers are mixed homogeneously enough to prevent the filament cutting upon spin-drawing, which is a factor to deteriorate the workability and physical properties of the fibers. Then, while being taken up at a high speed of 2,000 m/min or greater, the polymer released from the nozzle is quickly cooled by maintaining at 250° C. or lower the temperature just below the nozzle, so as to obtain an effect of maximizing undrawn orientation.

Further, the present invention is characterized in aqueous emulsion oiling agents used in high speed, direct spin-drawing processes without complications. The aqueous emulsion oiling agents according to the present invention enjoy advantages in that the processing procedure of preparing industrial polyester fibers can be conducted stably without deterioration of processability, but with an economical profit.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A method for preparing industrial polyester fibers, comprising the steps of:

producing polyester chips through the solid-polymerization of polyester low chips comprising an antimony compound at a residual content of 200–400 ppm as calculated by antimony metal, said polyester chips ranging, in instrinsic viscosity, from 1.00 to 1.15 with a moisture content of 30 ppm or less;

melt-spinning the polyester chips through a nozzle contained within a pack, wherein said polyester chips were melted at a temperature of 290–300° C. and extruded to conduits of polymer dispersing plates, each conduit having a static mixer composed of at least three units;

oiling the filaments released from the nozzle, at an Oil Pick Up of 0.3–0.8% with a 10–30%, aqueous emulsion oiling agent prepared from a raw solution which comprises dialkyl-thio-diester, and fatty acid monester or alkyl alkylate at an amount of 50 weight % or greater with the dialkyl-thio-diester amounting to at least 30 weight % of the raw solution, said oiling agent functioning as a lubricating agent;

taking up the multifilament yarn at a speed of 2,000–3,300 m/min to obtain undrawn yarn ranging, in intrinsic viscosity, from 0.95 to 1.02 and, in orientation degree, from $40\times10^{-3}$ tp $90\times10^{-3}$; and continuously drawing the undrawn yarn.

2. A method as set forth in claim 1, wherein the polymers are filtered through at least three sheets of filters within the pack after being melted and before being extruded to said conduits.

3. A method as set forth in claim 1, wherein the filaments are allowed to pass through a distance of 140–220 mm from the nozzle to a quenching zone, which is maintained at 200–250° C. and through the quenching zone wherein the filaments are cooled.

4. A method as set forth in claim 1, wherein said continuously drawing step is conducted in a three-step manner in which draw ratios are controlled and a final heat-setting roller has a temperature of 190–235° C., to produce drawn yarns having a fineness of 2–5 deniers per monofilament.

* * * * *

UNITED STATES PATENT AND TRADEMARK OFFICE

CERTIFICATE OF CORRECTION

PATENT NO. : 6,312,634 B1 
DATED : November 6, 2001
INVENTOR(S) : Eun Lai Cho, Duk Ho Oh and Hyek Se Lee It is certified that error appears in the above-identified patent and that said Letters Patent is hereby corrected as shown below:

Column 1,
Line 11, replace “pre sent” with -- present --;

Column 6,
Line 41, replace “0. 95-1.02,” with -- 0.95-1.02, --;

Column 7,
Line 8, replace “6:4,” with -- 6 : 4, --;

Column 8,
Line 7, replace “during24” with -- during 24 --;
Line 17, move “(10) E+S” to the next line by itself;

Column 14, line 67 and Column 15, line 1,
Replace “main” and “tained” with -- maintained --;

Column 20,
Line 26, replace “140-220 mm” with -- 140-220mm --.

Signed and Sealed this

Sixth Day of August, 2002

*Attest:*

*Attesting Officer*

JAMES E. ROGAN
*Director of the United States Patent and Trademark Office*